US010987529B2

(12) United States Patent
Hudak et al.

(10) Patent No.: US 10,987,529 B2
(45) Date of Patent: Apr. 27, 2021

(54) FIRE EXTINGUISHER

(71) Applicant: Nottingham Spirk Design Associates, Cleveland, OH (US)

(72) Inventors: Thomas Hudak, Wooster, OH (US); Jeffrey Silver Taggart, Cleveland Heights, OH (US)

(73) Assignee: Nottingham Spirk Design Associates, Cleveland, OH (US)

( * ) Notice: Subject to any disclaimer, the term of this patent is extended or adjusted under 35 U.S.C. 154(b) by 0 days.

(21) Appl. No.: 14/345,785

(22) PCT Filed: Sep. 19, 2012

(86) PCT No.: PCT/US2012/056079
§ 371 (c)(1),
(2) Date: Mar. 19, 2014

(87) PCT Pub. No.: WO2013/043700
PCT Pub. Date: Mar. 28, 2013

(65) Prior Publication Data

US 2014/0231109 A1 Aug. 21, 2014

Related U.S. Application Data

(60) Provisional application No. 61/536,489, filed on Sep. 19, 2011, provisional application No. 61/568,833, filed on Dec. 9, 2011.

(51) Int. Cl.
*A62C 13/00* (2006.01)
*A62C 13/78* (2006.01)
(Continued)

(52) U.S. Cl.
CPC ..... *A62C 13/00* (2013.01); *A62C 13/62* (2013.01); *A62C 13/64* (2013.01); *A62C 13/68* (2013.01);
(Continued)

(58) Field of Classification Search
CPC ..... A62C 99/0018; A62C 13/64; A62C 13/00; A62C 35/02; A62C 13/68; A62C 13/66;
(Continued)

(56) References Cited

U.S. PATENT DOCUMENTS 3,092,183 A 6/1963 Guise et al.
3,870,105 A 3/1975 Gooch
(Continued)

OTHER PUBLICATIONS

International Search Report and the Written Opinion of the International Searching Authority, PCT/US12/056079, Akron Brass Company, dated Dec. 13, 2012.
(Continued)

*Primary Examiner* — Steven J Ganey
(74) *Attorney, Agent, or Firm* — Renner, Otto, Boisselle & Sklar, LLP

(57) ABSTRACT

A fire extinguisher is shown and described. The fire extinguisher may include a housing, a vessel positioned within the housing, the vessel retaining a fire suppression agent therein, and a discharge port positioned in the housing and operatively coupled with the vessel, where the fire suppression agent is capable of being expelled from the discharge port. The fire extinguisher may include an electrical connector positioned on the housing, the electrical connector capable of operatively securing to an electrical outlet, where the electrical connector is rotatable relative to the housing.

20 Claims, 9 Drawing Sheets

(51) Int. Cl.

| | |
|---|---|
| ***A62C 13/76*** | (2006.01) |
| ***A62C 13/68*** | (2006.01) |
| ***A62C 13/70*** | (2006.01) |
| ***A62C 13/64*** | (2006.01) |
| ***A62C 35/02*** | (2006.01) |
| ***A62C 13/62*** | (2006.01) |

(52) U.S. Cl.
CPC ..... *A62C 13/70* (2013.01); *A62C 13/76* (2013.01); *A62C 13/78* (2013.01); *A62C 35/02* (2013.01)

(58) Field of Classification Search
CPC ..... A62C 13/70; A62C 13/62; A62C 13/76; A62C 13/78
USPC ..... 169/30, 51, 71, 75, 85, 88
See application file for complete search history.

(56) References Cited

U.S. PATENT DOCUMENTS

| | | | | |
|---|---|---|---|---|
| 4,427,134 | A | 1/1984 | Almouli | |
| 4,650,004 | A * | 3/1987 | Wendling | A62C 13/74 169/85 |
| 4,887,674 | A | 12/1989 | Galosky et al. | |
| 5,848,651 | A | 12/1998 | McSheffrey et al. | |
| 6,189,624 | B1 | 2/2001 | James | |
| 6,641,286 | B2 | 11/2003 | Hincher, Sr. | |
| 6,917,754 | B2 | 7/2005 | Pedrotti et al. | |
| 7,343,981 | B2 | 3/2008 | Nappa et al. | |
| 7,398,793 | B2 | 7/2008 | Itano et al. | |
| 7,878,259 | B2 | 2/2011 | Gauthier | |
| 9,337,601 | B2 * | 5/2016 | Silva | G08B 21/0208 |
| 2001/0011567 | A1 | 8/2001 | Drakin | |
| 2003/0058645 | A1 * | 3/2003 | Hincher, Sr. | A62C 13/78 362/253 |
| 2004/0065451 | A1 * | 4/2004 | McSheffrey et al. | 169/75 |
| 2009/0173506 | A1 * | 7/2009 | Yoshida | A62C 13/64 169/89 |
| 2010/0147540 | A1 * | 6/2010 | Yoshida | 169/74 |
| 2010/0192695 | A1 * | 8/2010 | McSheffrey et al. | 73/753 |
| 2010/0294522 | A1 | 11/2010 | Rousseau et al. | |
| 2011/0097914 | A1 * | 4/2011 | Lee | H01R 29/00 439/174 |
| 2011/0266010 | A1 * | 11/2011 | Kang | A62C 17/00 169/52 |
| 2012/0126970 | A1 * | 5/2012 | Hsu | A62C 37/50 340/521 |
| 2014/0151071 | A1 * | 6/2014 | Pichard et al. | 169/30 |

OTHER PUBLICATIONS

International Preliminary Report of Patentability, PCT/US12/056079, Akron Brass Company, dated Mar. 25, 2014.

* cited by examiner

FIRE EXTINGUISHER

CROSS-REFERENCE TO RELATED APPLICATION

This application is the National Stage of International Application No. PCT/US2012/056079, filed Sep. 19, 2012, which claims the benefit from U.S. Provisional Patent Application No. 61/536,489 entitled "Fire Extinguisher" filed on Sep. 19, 2011, and U.S. Provisional Patent Application No. 61/568,833 entitled "Fire Extinguisher" filed on Dec. 9, 2011, both all of which are hereby incorporated in their entirety by reference.

FIELD

The present invention relates generally to a fire extinguisher, and more particularly to a functionally diverse and generally decorative fire extinguisher that may be operatively coupled to an electrical source and positioned on or in proximity to furnishings, appliances and the like.

BACKGROUND

Generally portable fire extinguishers are designed for fire suppression over specific areas. For example, each floor in a residence or commercial building will typically have one or two fire extinguishers. Portable fire extinguishers are relatively large devices and are not decorative in appearance. As a result, they are typically placed out of sight under counters, in storage cabinets and in garages and cellars. These locations are not always easily accessible when one needs the fire extinguisher. Furthermore, since the user does not have easy access to the fire extinguisher and thus does not see the fire extinguisher regularly, the user typically does not know whether the fire extinguisher is charged and ready for effective operation.

In addition, since the fire extinguisher is typically in storage for some time before it is needed, remembering the location of the fire extinguisher can be problematic. Consequently, the process of searching out, locating and retrieving a fire extinguisher may require additional time. In many cases the time that it takes to approach a fire, after the fire extinguisher has been located, may be undesirable under the circumstances allowing time for the fire to propagate.

Often, a decision is made not to attempt to return to the scene of the fire, considering the distance between the stored fire extinguisher and the location of the fire. In such cases the risk involved in obtaining the fire extinguisher is perceived to outweigh its potential benefit. Often, too, a fire may block access to the storage location of the fire extinguisher. In this situation the fire extinguisher is of little or no help.

Therefore, there is a need for a fire extinguisher that overcomes many of the shortcomings identified above. For example, there is a need for a compact and decorative fire extinguisher that may be operatively coupled to an electrical source, or operatively positioned on or in proximity to furnishings, appliances and the like or both. Further, there is a need for a fire extinguisher that may provide additional functionality and utility so that it is storable in an operative condition in a readily accessible location.

SUMMARY

A fire extinguisher is shown and described. The fire extinguisher may include a housing, a vessel positioned within the housing, the vessel retaining a fire suppression agent therein, and a discharge port positioned in the housing and operatively coupled with the vessel, where the fire suppression agent is capable of being expelled from the discharge port. The fire extinguisher may include an electrical connector positioned on the housing, the electrical connector capable of operatively securing to an electrical outlet, where the electrical connector is rotatable relative to the housing.

A fire extinguisher may include a housing, a vessel positioned within the housing, the vessel including a fire suppression agent, a discharge port positioned in the housing and operatively coupled with the vessel, where the fire suppression agent is capable of being expelled from the discharge, and an electrical connector positioned in the housing, the electrical connector capable of operatively securing to an electrical outlet. The fire extinguisher may also include an indicator positioned in the housing, the indicator identifying expiration of the fire suppression agent.

A fire extinguisher may include a housing, a vessel positioned within the housing, the vessel including a fire suppression agent, a discharge port positioned in the housing and operatively coupled with the vessel, where the fire suppression agent is capable of being expelled from the discharge port, and an electrical connector positioned in the housing, the electrical connector capable of operatively securing to an electrical outlet. The fire extinguisher may also include a light source positioned in the housing and operably secured to the electrical connector.

A fire extinguisher may include a housing, a vessel positioned within the housing, the vessel holding a fire suppression agent, a discharge port positioned in the housing and operatively coupled with the vessel, and an actuator positioned on the housing and operably coupled with the vessel, where actuation of the actuator initiates discharge of the fire suppression agent from the vessel through the discharge port. The fire extinguisher may also include an electrical connector positioned in the housing, the electrical connector capable of operatively securing to an electrical outlet.

A fire extinguisher may include a housing, a vessel positioned within the housing, the vessel retaining a fire suppression agent, and a discharge port positioned on the housing and operatively coupled with the vessel, where the fire suppression agent is capable of being expelled from the discharge port. The fire extinguisher may also include an electrical connector having a body, the body operatively and selectively coupled with the housing, where the electrical connector is capable of operatively securing to a power source.

BRIEF DESCRIPTION OF THE DRAWINGS

Operation of the invention may be better understood by reference to the detailed description taken in connection with the following illustrations, wherein.

DETAILED DESCRIPTION

Figure 1:
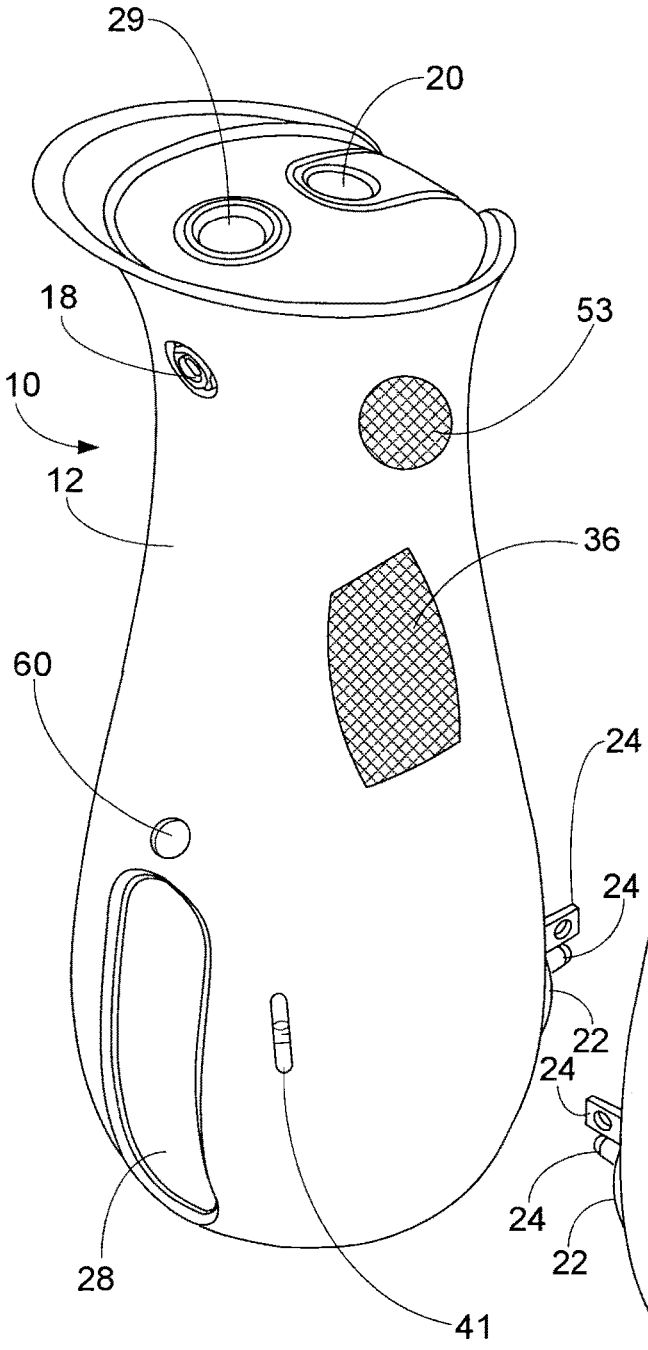
FIG. 1 is a first side perspective view of embodiments of a fire extinguisher.
Figure 2:
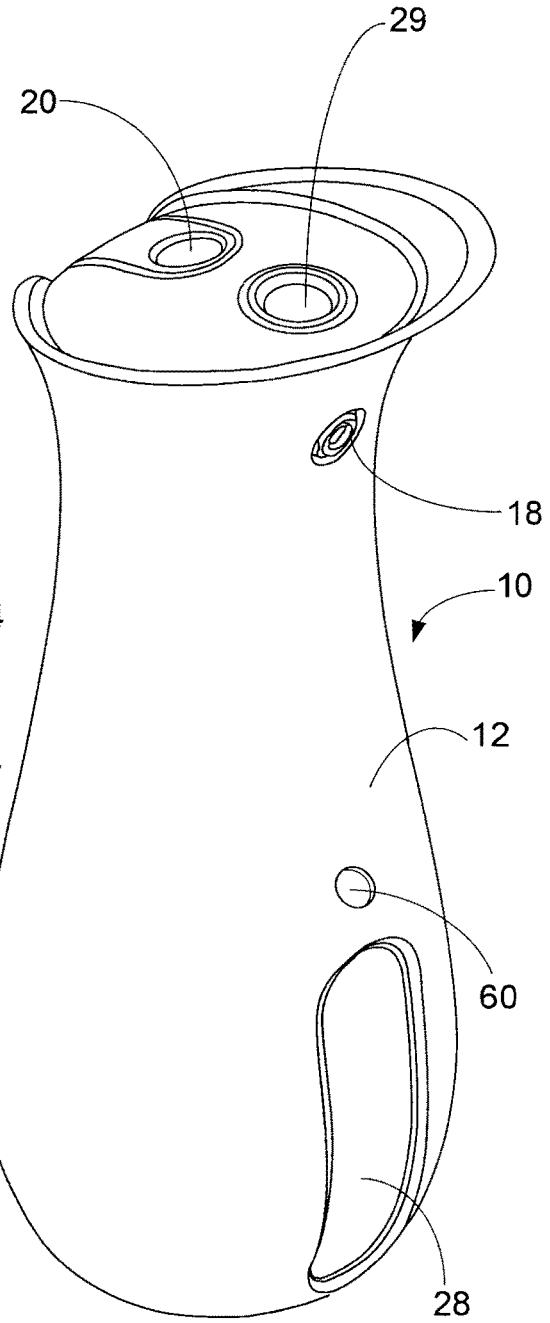
FIG. 2 is a second side perspective view of the fire extinguisher.
Figure 3:
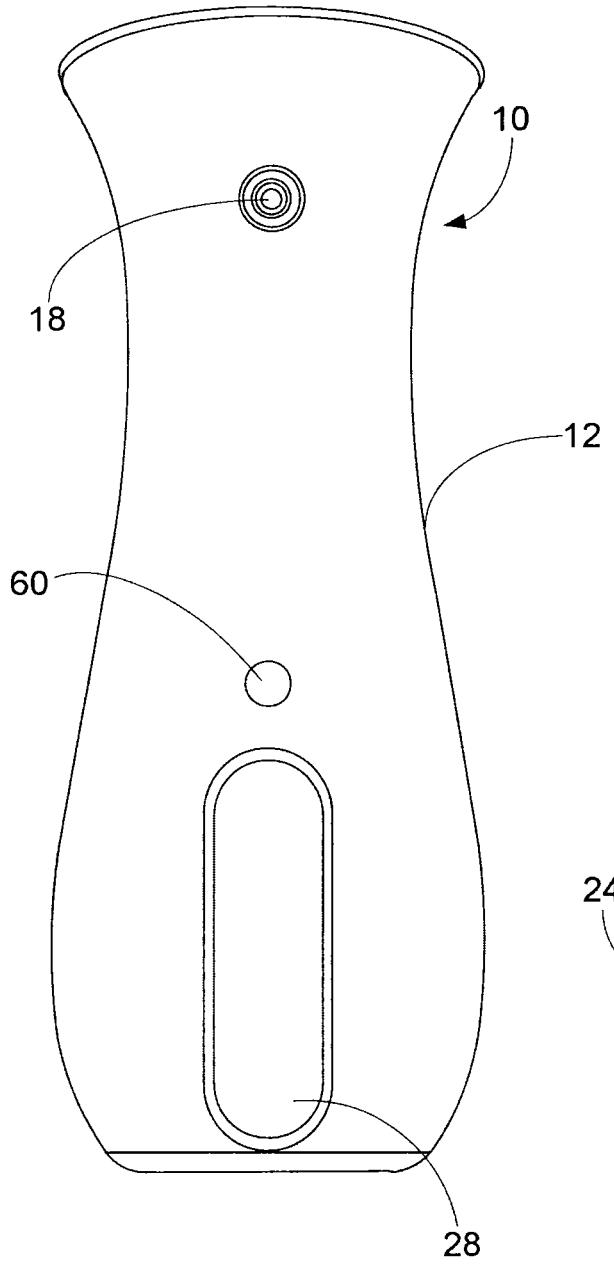
FIG. 3 is a front view of the fire extinguisher.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

The general arrangement of embodiments of a fire extinguisher 10 is shown in FIGS. 1 through 8. The fire extinguisher 10 may include a housing 12 of any appropriate shape and size, such as a compact size. The housing 12 may be made of an aesthetically pleasing shape such that fire extinguisher 10 is considered a decorative piece. By way of a non-limiting example, the housing 12 may be of such an appropriately decorative appearance that the fire extinguisher 10 is used as part of a décor of a room. This may incentivize or otherwise allow a user to place and store the fire extinguisher 10 in view of the user. This may result in the fire extinguisher 10 being readily accessible to the user when needed as opposed to being placed in a storage device out of sight. The housing 12 may be made of any appropriate material—the present teachings are not limited to a specific material. By way of a non-limiting example, the housing may be made of plastics, composites, stainless steel, aluminum, tungsten, wood veneer, other metals, rubber, or any combination of such.

The housing 12 may be of any appropriate color and include decorative finish. As previously noted, the color and finish of the housing 12 may lend itself to being decorative and aesthetically pleasing such that the fire extinguisher 10 may be part of the décor of the room in which it is placed—many different combinations of color and finish may be available, for example, matte, glossy, etc.

Further, the fire extinguisher 10 may include a wrap or covering (not shown) capable of circumscribing the housing 12. The wrap or cover may provide additional options for color and finish allowing a user to change the appearance of the fire extinguisher 10, such as when the décor of a room in which it is stored changes. The wrap or cover may have any appropriate color and finish—the present teachings are not limited to any specific color or finish. By way of a non-limiting example, the wrap or cover may be faux wood, faux metal (stainless steel, aluminum or the like), any color, and may have a variety of finishes such as matte, glossy, etc. The wrap or cover may be attached to the housing 12 in any appropriate manner, e.g., it may be a static cling, it may be adhered, or any other suitable method may be employed. The wrap or cover may be removably attached to the housing 12 or it may be permanently fixed such as through the use of adhesives. Additional wraps or covers may be attached or layered over an existing wrap or cover already attached to the housing 12. It should be understood, that the wrap or cover may optionally be included with the fire extinguisher 10 or may optionally not be included with the fire extinguisher 10.

The fire extinguisher 10 may include a vessel 14 disposed within and generally held in the housing 12 such that the vessel 14 may not be generally visible from the exterior of the fire extinguisher 10. The vessel 14 may be configured to generally contain and store any applicable fire suppression agent 16. Further, the vessel 14 may be made from any appropriate material, for example, it may be made from a material that will not negatively interact with the fire suppression agent 16. The vessel 14 may be made of generally the same material as the housing 12, or may be made of a different material. Accordingly, the vessel 14 may be integrally formed as a monolithic unit with the housing 12 or may be attached and positioned within the housing 12.

The fire extinguisher may further include a discharge port 18 positioned within the housing 12 at any appropriate position thereon. The discharge port 18 may allow for expulsion of the fire suppression agent 16 from the vessel 14 out of the fire extinguisher 10. The discharge port 18 may be operably coupled to the vessel 14 by any appropriate actuator 20.

The fire suppression agent 16 may be any suitable material that suppresses or extinguishes fire. Accordingly, any combination of expellant and suppressant agents now known or later invented may be utilized within the scope of the present teachings. The fire suppression agent 16 may further include any suitable combination of solid and liquid aerosols. By way of a non-limiting example, the fire suppression agent 16 may include, but are not limited to, a pressurized aerosol foam or spray. Alternatively, pyrotechnic-based chemicals for fire suppression generators may be utilized without departing from the present teachings.

The discharge port 18 may provide an exit path for the fire suppression agent 16 when the fire extinguisher 10 is in use, i.e., when the actuator 20 is activated by a user or otherwise automatically activated. The discharge port 18 may be sized and shaped to provide any desired discharge rate for the fire suppression agent 16. In addition, the discharge port 18 may include directive or shaping elements to direct the discharge, i.e., the fire suppressant agent 16 in any desired direction or spray pattern. The directive or shaping elements may be fixed, adjustable by the user, or automatically adjusted based upon several relevant factors related to the operating conditions of the fire extinguisher 10. A portion of the discharge port 18 may extend outward of the housing 12 while the remaining portion is positioned within the housing 12. Further, the discharge port 18 may be positioned entirely within the housing 12. The discharge port 18 may be operably positioned generally between the vessel 14 and the actuator 20.

The actuator 20 may be a manual device sized and shaped for activation by a user to generally cause the fire suppression agent 16 to flow from the discharge port 18. The actuator 20 may be positioned in any appropriate location on the housing 12. The actuator 20 may be positioned such that it may be readily engageable by the user during operation of the fire extinguisher 10. By way of a non-limiting example, the actuator 20 may be located on a top portion of the housing 12 such that a user may hold the fire extinguisher 10 and the actuator 20 may be positioned such that the user can readily operate such—although it may be in any appropriate position on the housing 12. The actuator 20 may have a low profile with respect to the housing 12. For example, the actuator 20 may be generally flush with the housing 12, slightly depressed below the housing 12, or may extend slightly above the housing 12. The actuator 20 having a low profile may contribute to the fire extinguisher 10 being decorative.

In embodiments in which the actuator 20 may be manually operable, the actuator 20 may be biased toward an "off" position, requiring a user to continuously activate the actuator 20 in order to maintain the discharge of the fire suppression agent 16 from the discharge port 18. Any appropriate device or devices may be used to bias the actuator 20 toward the "off" position, including, by way of a non-limiting example, biasing member, spring (coil, leaf, compression, torsion or any kind of spring), live hinge, or the like—the present teachings are not limited to a particular configuration.

Further, the actuator 20 may be configured to latch into an "on" position once manually activated, obviating the need for a user to continuously actuate the actuator 20. The user may then aim the discharge port 18 at a fire, or the user may toss or throw the fire extinguisher 10 into a fire to aid in suppression of the fire. Any appropriate latching mechanism may be used without departing from the present teachings.

Still further, the latching-type manual actuator 20 may include a timing element (not shown) whereby a predetermined amount of time may pass after the actuator 20 actuates before discharge of the fire suppression agent 16 from the discharge port 18 is initiated. The timing element may allow a user to actuate the actuator 20 and move away from, toss or throw the fire extinguisher 10 without significant exposure to the fire suppression agent 16. Any appropriate timing mechanism may be used without departing from the present teachings.

The fire extinguisher 10 may also include a latching-type manual actuator 20 capable of being biased between an "off" and "on" position by the user. In the "off" position, the user may continuously activate the actuator 20 in order to maintain the discharge of fire suppression agent 16 from the discharge port 18. In the "on" position, the user may aim the discharge port 18 at a fire, or the user may toss or throw the fire extinguisher 10 into a fire to aid in suppression of the fire. It should be understood that any appropriate actuator 20 may be used without departing from the present teachings.

Additionally, the actuator 20 may be configured to detect the presence of a fire by any suitable means, such as thermal detection, infrared fire detection, or both. Such actuator 20 may automatically cause the fire suppression agent 16 to flow from the discharge port 18. In alternative embodiments the actuator 20 may be both manual and automatic.

The fire extinguisher 10 may further include a remote puncturable high-pressure gas cartridge 21 that may be positioned within the housing 12 and operably coupled with the discharge port 18 and the actuator 20. In this fire extinguisher 10, the gas cartridge 21 may be punctured before expulsion of the fire suppression agent 16 from the fire extinguisher 10. The gas cartridge 21 may be metered into the vessel 14 on demand throughout the discharge process to act as a propellant for the fire suppression agent 16. The gas cartridge 21 may be any appropriate shape and size and may include any appropriate gas—the present teachings are not limited to such. By way of a non-limiting example, the gas cartridge 21 may be a carbon dioxide gas cartridge that includes carbon dioxide gas under pressure.

The gas cartridge 21 may be metered through use of a metering device 23. The metering device 23 may be a pressure regulator—or any other suitable device—that may maintain a predefined, substantially lower pressure in the vessel 14. In these embodiments, the fire suppression agent 16 may be in the form of a powder such that it may be combined with the gas from the gas cartridge 21 acting as the propellant and expelled from the discharge port 18 during operation.

The gas cartridge 21 may be punctured, such as through activating the actuator 20. Upon activation, the gas contained in the gas cartridge 21 may be expelled into the vessel 14 in a metered manner as described above. In these embodiments, the actuator 20 may be configured such that when the user depresses the actuator 20, a portion of the actuator 20 punctures the gas cartridge 21. This initial depression of the actuator 20, however, will not expel the fire suppression agent 16 from the fire extinguisher 10. In order to expel the fire suppression agent 16, the user may depress or otherwise activate the actuator 20 a second time—such as described above. It is not until this second depression or activation occurs will the fire suppression agent 16 be expelled from the fire extinguisher 10. This results in the actuator 20 being a two-part mechanism. To expel the fire suppression agent 16 from the fire extinguisher 10, the user may depress the actuator 20 once puncturing the gas cartridge 21 and then may actuate (such as through pushing or pulling) the actuator 20 a second time.

The initial depression of the actuator 20 not expelling the fire suppression agent 16 may act as a safety mechanism for the fire extinguisher 10. This feature may prevent a user from inadvertently depressing the actuator 20 and expelling the fire suppression agent 16. This is particularly useful if a child were to pick up the fire extinguisher 10 and depress the actuator 20. In such circumstances, the fire suppressant agent 16 would not be expelled from the fire extinguisher 10.

Further, the fire extinguisher 10 may include an orifice (not shown) that may be associated with a valve (not shown) positioned in the housing 12 that may open only when the actuator 20 is activated, e.g., initially depressed. This may result in generally preventing the vessel 14 from being fully pressurized when not in use and the gas/propellant may be metered in a controlled manner while being used in the fire extinguisher 10. This may allow housing the high-pressure gas outside of the larger powder—fire suppression agent 16—chamber/vessel 14. This may substantially lower mechanical demands of the vessel 14 since an initial high pressure charge is not needed in order to ensure proper pressure is maintained at the end of the discharge of the fire extinguisher 10. Additionally, since the high pressure may be held elsewhere than the vessel 14 until the fire extinguisher 10 is used, the long-term fatigue and stress the vessel 14/powder chamber is typically exposed to over the fire extinguisher 10 shelf-life may be generally avoided. This may allow the fire extinguisher 10 to be lighter than prior art fire extinguishers.

The fire extinguisher 10 may include an electrical connector 22. The electrical connector 22 may be positioned on the housing 12 of the fire extinguisher 10 in any appropriate location. The electrical connector 22 may be configured of any suitable size and shape such that it is operatively coupled with any appropriate electrical source. The present teachings of the electrical connector 22 are not limited to that shown and described herein—any appropriate electrical connector may be used without departing from the present teachings. The electrical connector 22 may be integrally formed with the housing 12. The electrical connector 22 may be welded, adhered or otherwise attached to housing 12 in any suitable manner. Alternatively, the electrical connector 22 may be formed with the housing 12 as a monolithic unit.

One or more connecting elements 24 may be capable of operatively coupling the fire extinguisher 10, or more specifically, the electrical connector 22, to any suitable power source. This may include standard AC power outlets, such as those found in homes and offices. The electrical connector 22 may include any suitable standard or proprietary/unique connecting elements 24 capable of coupling to an electrical power source, which may be AC or DC current. The electrical connector 22 may be fixedly secured to the housing 12, or alternatively the electrical connector 22 may be positionable relative to the housing 12. By way of a non-limiting example, the electrical connector 22 may be rotatable relative to the housing 12 to facilitate placement of the fire extinguisher 12 on an electrical outlet and orient such to a desired position, for example, a generally vertical or horizontal orientation.

Figure 4:
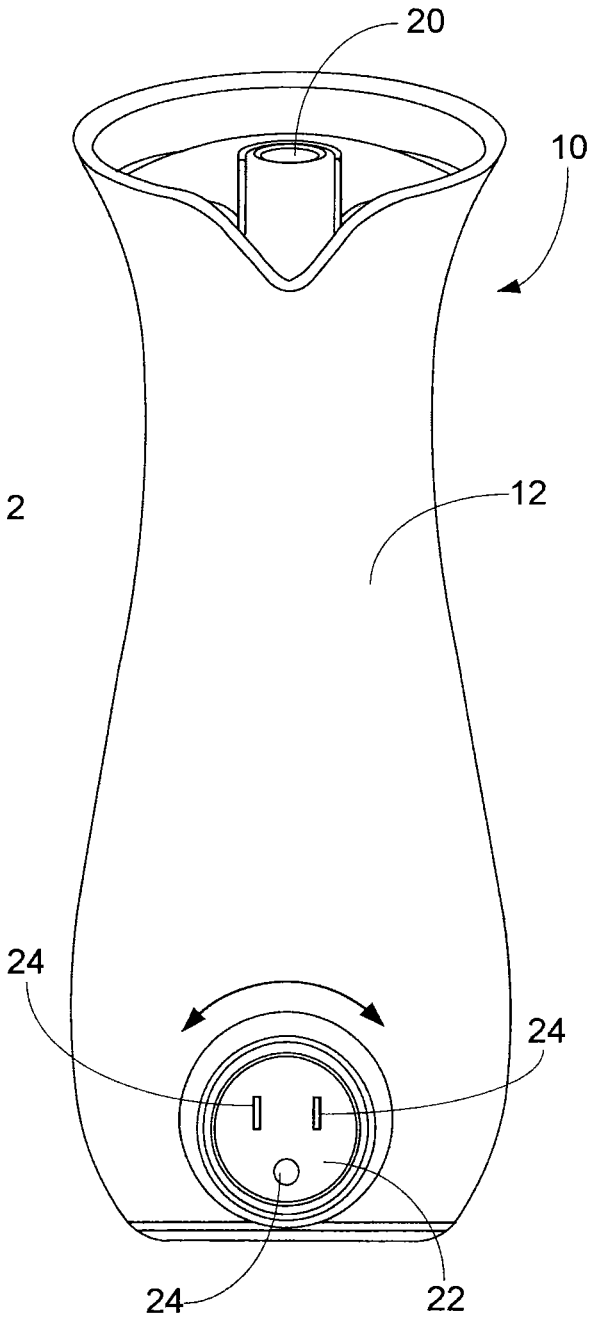
FIG. 4 is a rear view of the fire extinguisher.
Figure 5:
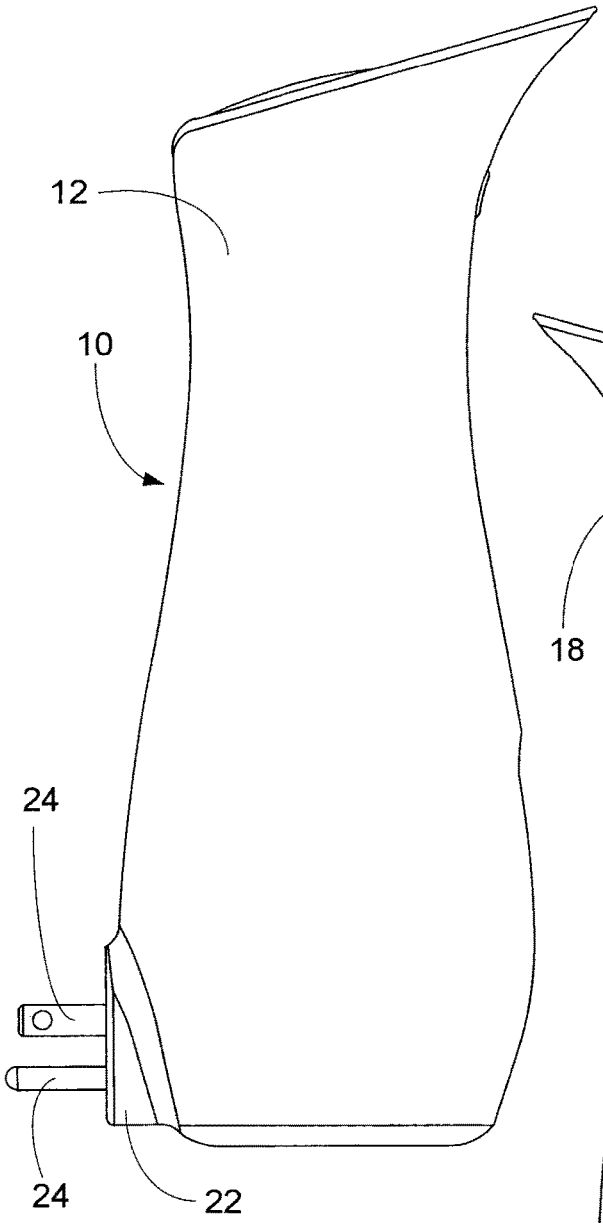
FIG. 5 is a first elevation view of the fire extinguisher.
Figure 6:
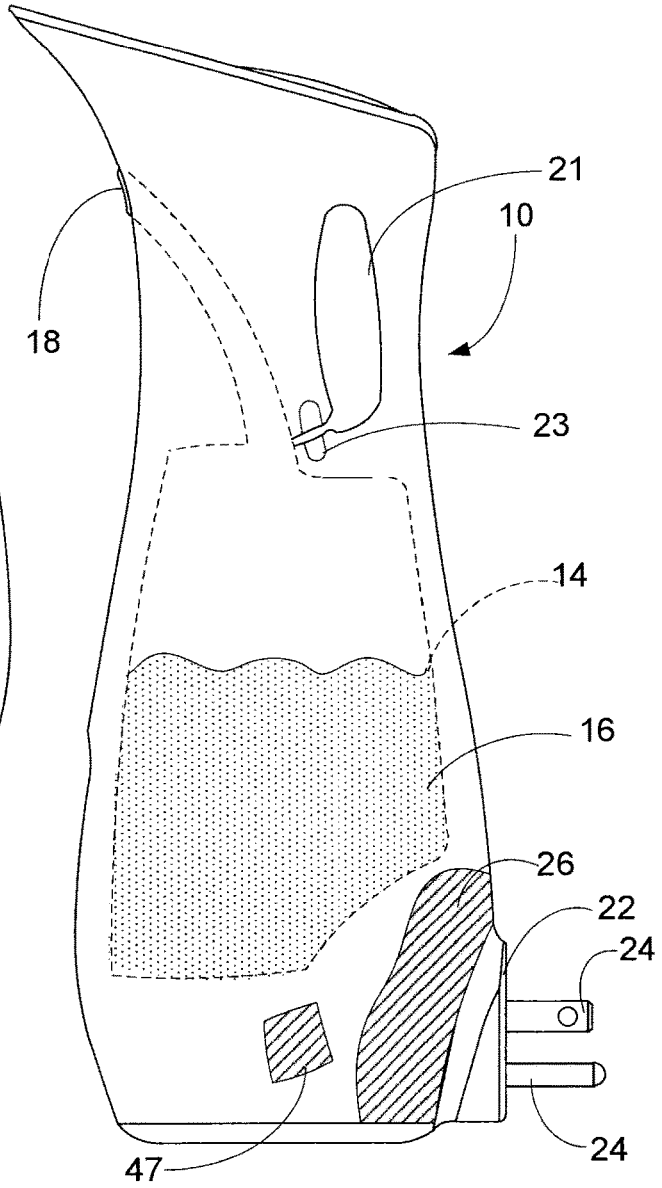
FIG. 6 is a second elevation view of the fire extinguisher.
Figure 7:
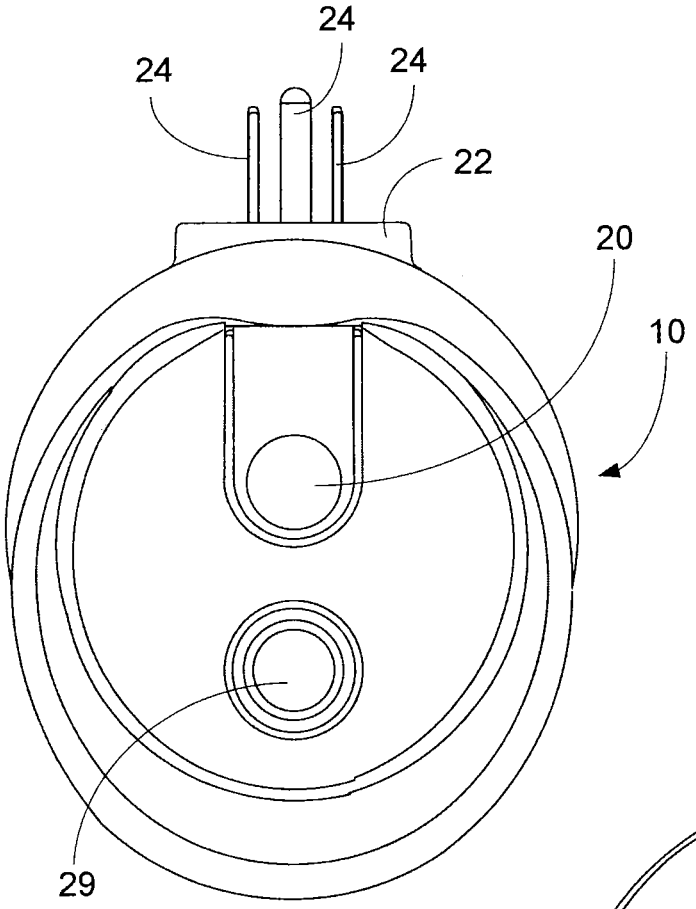
FIG. 7 is a plan view of the fire extinguisher.
Figure 8:
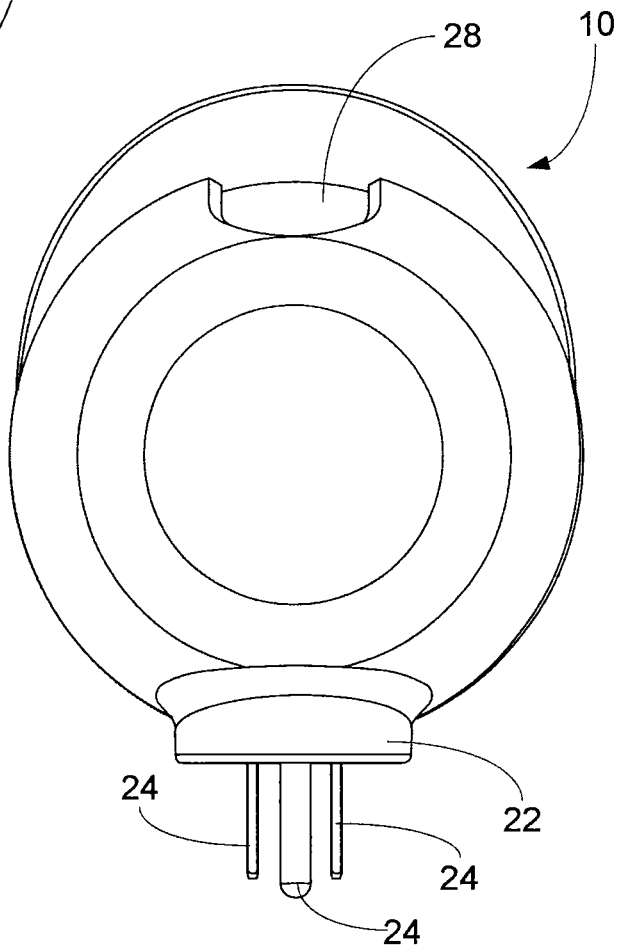
FIG. 8 is a bottom view of the fire extinguisher.
Figure 9:
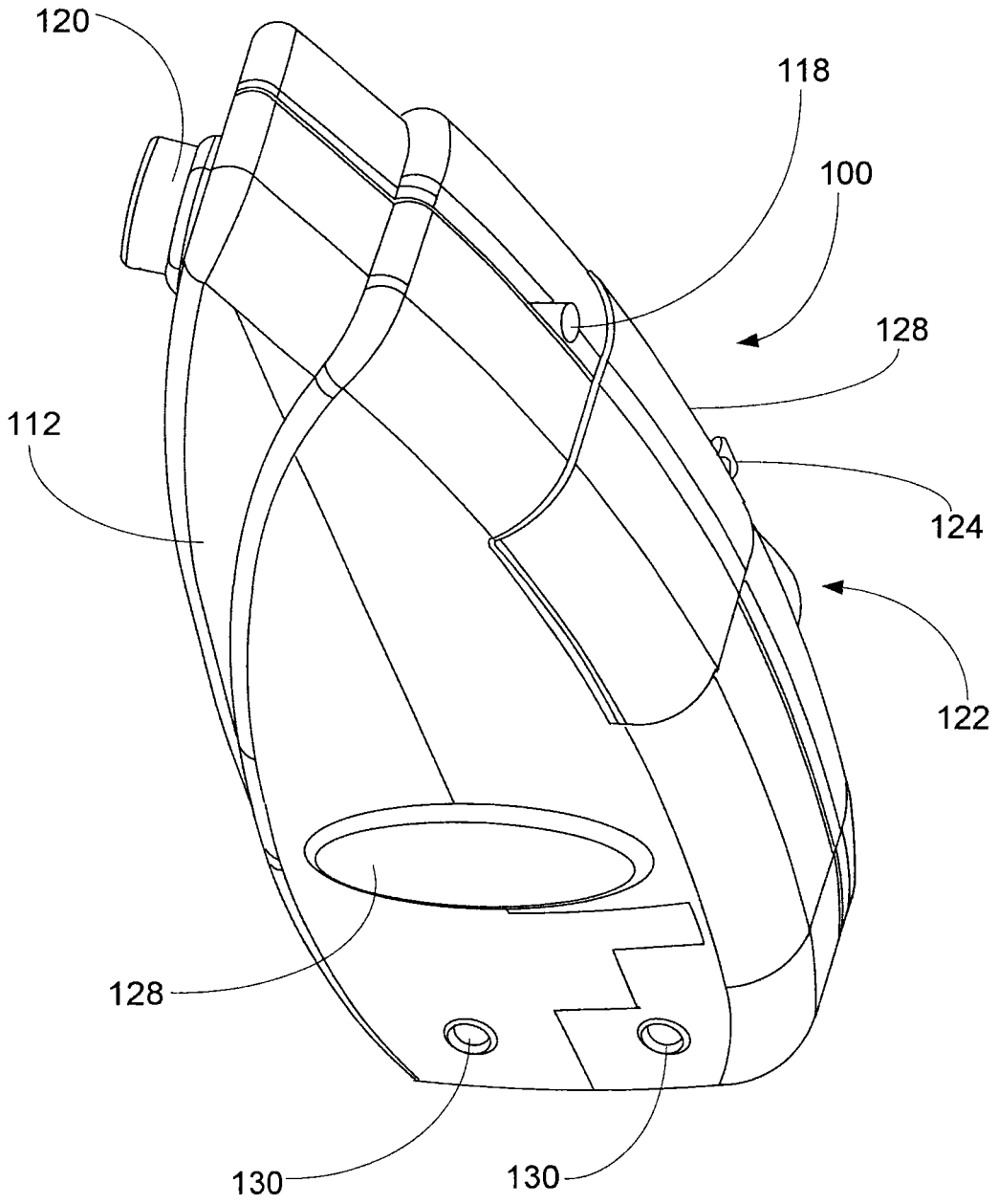
FIG. 9 is a perspective view of other embodiments of a fire extinguisher.
Figure 10:
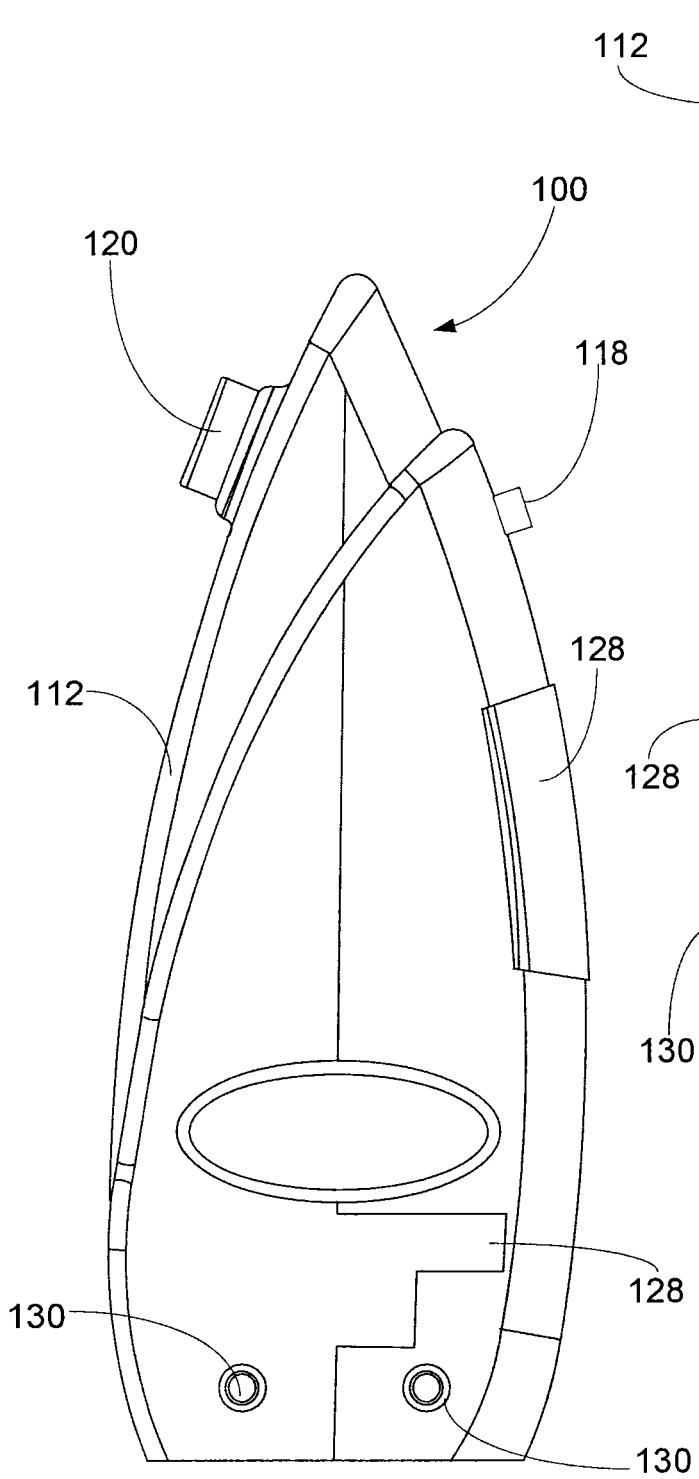
FIG. 10 is a first elevational view of the fire extinguisher of FIG. 9.
Figure 11:
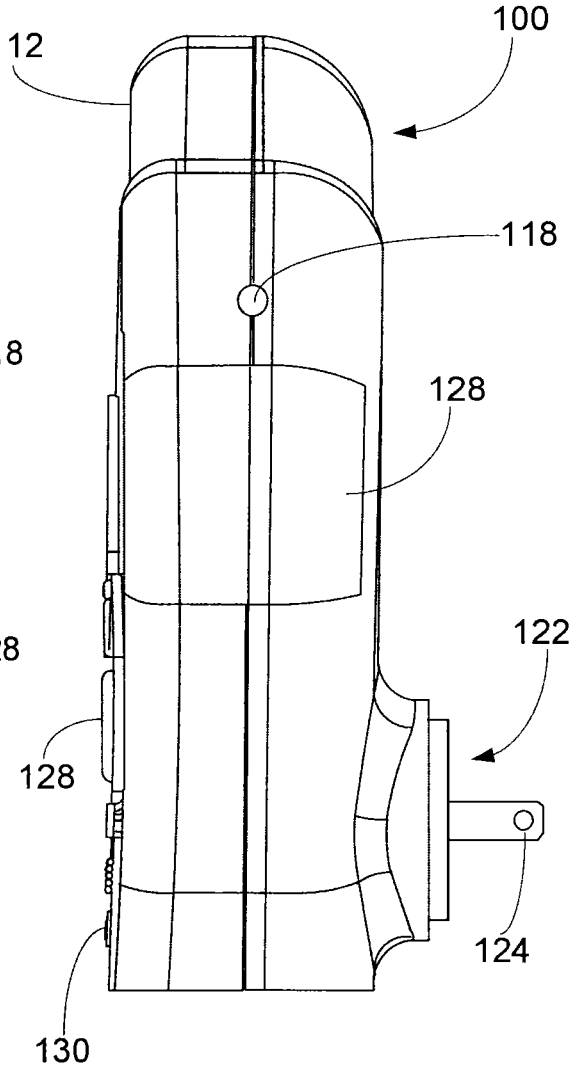
FIG. 11 is a second elevational view of the fire extinguisher of FIG. 9.
Figure 12:
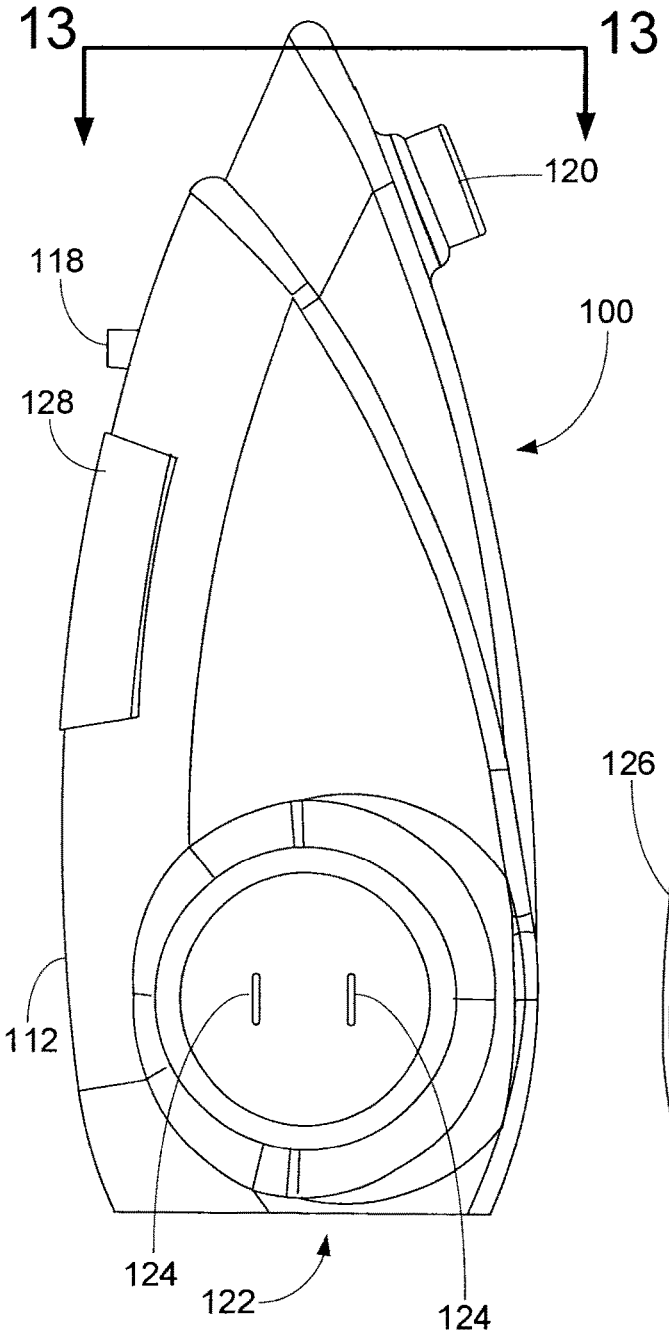
FIG. 12 is a rear view of the fire extinguisher of FIG. 9.
Figure 13:
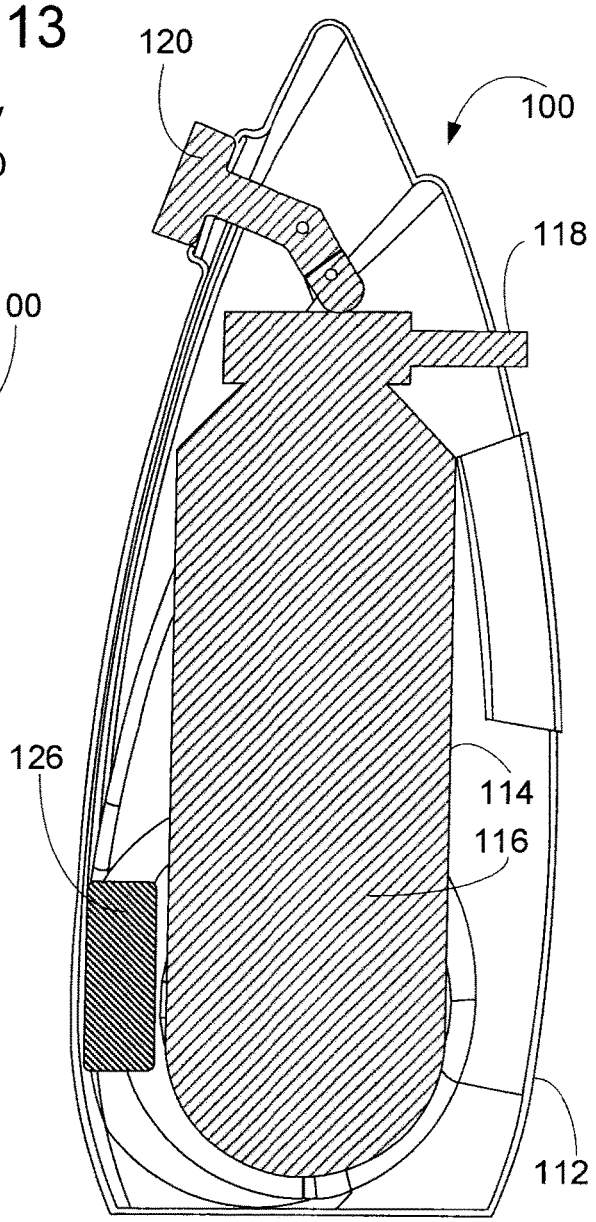
FIG. 13 is a cross-sectional view of the fire extinguisher of FIG. 9 taken along line 13-13.

In those embodiments in which the electrical connector 22 may be positionable, such as that shown in FIG. 4, the electrical connector 22 may rotate relative to the housing 12 by any appropriate amount. By way of a non-limiting example, the electrical connector 22 may be capable of rotating at least 360 degrees relative to the housing 12. Further, the electrical connector 22 may be rotatable in a clockwise direction, a counter-clockwise direction or both. Still further, the electrical connector 22 may be continuously rotatable in any appropriate direction. This may result in the electrical connector 22 rotating in any of a clockwise or counter-clockwise direction or both generally without limitation to a number of rotations. The electrical connector 22 may also be limited in the amount it is capable of rotating, such as 180 degrees or the like. Such rotatable electrical connector 22 may allow the fire extinguisher 10 to attach to an electrical source such that the housing 12 may remain in a predetermined position relative to the horizon, for example, generally vertical or horizontal to the horizon, regardless of the location or orientation of the electrical source. This may, therefore, allow the fire extinguisher 10 to attach to a standard electrical outlet in a house, office, business, or other location such that the housing 12 may be positioned in a vertical or horizontal orientation relative to the ground. This may make the fire extinguisher 10 easier to grasp, especially during an emergency situation. This may also generally allow the fire extinguisher 10 to blend in with the décor of the room in which it is stored.

Further, the electrical connector 22 may be used solely as a mechanical connector to detachably mount the fire extinguisher 10 to a mating electrical connector, such as a standard electrical outlet as described above. Alternatively, the electrical connector 22 may be coupled to electrical power from an external source, such as the aforementioned electrical outlet, the electrical power at the electrical connector in turn being electrically coupled to a power supply 26 disposed within housing 12. The power supply 26 may be any suitable type of power supply, converting the electrical power to one or more AC or DC voltage levels and current ratings. The power supply 26 may also include one or more electrical storage devices, such as at least one or more batteries, and may further include a charging circuit (not shown) to charge any such batteries using electrical power from the aforementioned external power source. The fire extinguisher 10 may, therefore, have power to perform certain functions even if the fire extinguisher 10 is disconnected from the electrical source, as described in more detail below.

The external electrical power provided to the electrical connector 22 (or electrical power provided by power supply 26) may optionally be used to power one or more visually perceivable displays 28, such as an indicator, to facilitate identification of the fire extinguisher 10 in the event that other illumination is not available. This may enable a user to locate the fire extinguisher 10. Further, the electrical power may automatically actuate the actuator 20 as detailed above, without the need for manual intervention of a user, when the fire extinguisher 10 is in the presence of a detected fire. The display 28 may also operate as a night light, and may optionally include sensors 29 (described in more detail below), such as light sensors, to turn off or on the displays 28, including the night light, when a predetermined level of ambient light is detected or an absence of light is detected.

The display 28 may be positioned within the housing 12 at any appropriate location. The fire extinguisher 10 may include one display 28 or a plurality of displays 28 and the displays 28 may be of any appropriate type; the present teachings are not limited to a specific number of or type of displays 28. The displays 28 may include an LED display, a night light or a light source that may act as a flash light, or a combination of the foregoing. As discussed above, the fire extinguisher 10 may include the night light 28 positioned within the housing 12. The night light 28 may include light sensors 29 that may turn off the night light when a predetermined level of ambient light is detected. The fire extinguisher 10 also may include a smoke detector 36 that initiates operation of the light 28 when a predetermined amount of smoke is detected. The light 28 may act and emit as much light as a typical flash light. The light 28, smoke detector 36, and light sensor(s) 29 may all be operatively coupled with the power supply 26, the electrical connector 22, or both. The light 28, smoke detector 36, and light sensor(s) 29 may be positioned on the housing 12 in any appropriate position. The present teachings are not limited to a specific configuration. Still further, the fire extinguisher 10 may include any appropriate combination of the lights 28 (both or either of a night light or a flash light), smoke detector 36, and light sensor(s) 29.

The fire extinguisher 10 may include both the night light and the flashlight. In such embodiments, the fire extinguisher 10 may include an actuator 41 positioned on the housing 12 and operatively coupled with the electrical connector 22, the power source 26, or both. The actuator 41 may be actuated to switch between the night light 28 and the flash light 28. Still further, as noted above the fire extinguisher 10 may include the sensor 29 or sensors that detect the absence of ambient light and initiate or continue operation of the night light 28. Further, the fire extinguisher 10 may include the smoke/fire detector 36 such that the detection of fire or smoke many initiate operation of the flashlight 28 regardless of which operation the actuator is set to by the user.

The fire extinguisher 10 may include an electrical power sensor 47 such that if the electrical connector 22 is plugged into an electrical source and the electrical source is not providing electrical power to the fire extinguisher 10, the electrical power sensor 47 may identify this lack of power and initiate the flashlight 28 to operate and emit light. This may provide a further security feature of the fire extinguisher 10 such that it may emit light during a power outage. This may also allow the user to locate the fire extinguisher 10 during the power outage.

Further still, the fire extinguisher 10 may include a smoke/fire detection and alerting device 53. The device 53 may detect the presence of smoke or fire and activate an aural alert, visual alert, or both. In some embodiments, the fire extinguisher 10 may include a sensor (not shown) that may be capable of detecting gases such as carbon monoxide and may be capable of activating an alarm. The alerting device 53 may emit a high-powered high-decibel locator noise such that the user may locate the fire extinguisher 10 or rescue workers may locate the user.

In other embodiments the fire extinguisher 10 may include one or more status indicators 60. The status indicators 60 may indicate to a user the condition of the fire extinguisher 10, such as charging status of the battery of power supply 26, a need for replacement of batteries, whether or not the pressure or other condition of fire suppression agent 16 is acceptable (e.g., is there a leak in the fire extinguisher 10, for example, the vessel 14), whether the fire suppression agent 16 may have exceeded its intended shelf life, the fire suppression agent 16 being depleted such as through usage or leaks, the unavailability of any propellant that may be used to expel the fire suppression agent 16 under pressure, whether the lights are functional, and any combination of such. The status indicator 60 may include a light source, such as an LED, that emits a green light when the fire extinguisher 10 is in an operative condition and emits a red light when the fire extinguisher is in an inoperative condition. This may result in the user being able to easily identify the operating condition of the fire extinguisher 10, i.e., green is ready to go and red is replace or repair.

The status indicator 60 may be powered by the aforementioned external power source or power supply 26 to monitor the amount of fire expellant and suppressant remaining in the fire extinguisher 10 and provide a visual alert, aural alert, or both if the remaining amount falls below a predetermined level. Similarly, the status indicator 60 may be powered by the aforementioned external power source or power supply 26 may provide a visual alert, aural alert or both if the fire extinguisher 10 should be replaced. Criteria for triggering such a replacement indication may include, without limitation, vessel 14 pressure level, amount of fire suppressant agent 16 remaining in the vessel 14, and an expiration date of fire extinguisher 10 as determined by an internal clock or other timekeeping device.

In operation, in the event of a fire a user may simply locate a nearby fire extinguisher 10 and activate the actuator 20. The user may initially depress the actuator 20, which prepares the fire extinguisher 10 for operation as described above. If the actuator 20 is a manual, biased mechanism the user may then continually activate the actuator 20 while aiming the discharge port 18 at the fire. If the actuator 20 is a manual latching mechanism (with or without a time delay element) the user may activate the actuator 20 and then may aim discharge port 18 at the fire or toss or throw the fire extinguisher 10 into the fire. If the actuator 20 is automatic, in the event of a fire being detected, the actuator 20 may automatically be activated to cause the fire suppression agent 16 to flow from the discharge port 18.

The present fire extinguisher 10 may be relatively small, compact and decorative and capable of being plugged into existing electrical outlets or be battery powered and may simply placed upon furniture or appliances to provide for easy access and close proximity to a fire. This may result in more effective fire suppression as compared to currently-available fire extinguishers. The fire extinguisher 10 being capable of installing on electrical outlets or simply being placed upon furniture throughout a residence or commercial building may provide easy access and closer proximity between the fire extinguisher 10 and the location where a fire originates.

This proximity between the fire extinguisher 10 and a fire may create a more effective approach to fire suppression—residences and commercial buildings may have the fire extinguishers 10 in every room or even multiple fire extinguishers 10 in one room, for instance. Also, since the fire extinguisher 10 may be relatively small, non-intrusive decorative elements it may not detract from the overall appearance or decor of a residence or commercial building.

In various embodiments of the fire extinguisher 10, it may be configured (or reconfigurable) to function as a manually or automatically activated device. Furthermore, the fire extinguisher 10 may be configured (or reconfigurable) as a fixed or a throwable, self-activated fire extinguisher. It should be noted that the present fire extinguisher 10 may be used as a fire extinguisher for any or all of Class A, B, C and D fires as well as for Low, Moderate and High fire hazards.

Additional embodiments of a fire extinguisher according the present teachings are described below. In the descriptions, all of the details and components may not be fully described or shown. Rather, the features or components are described and, in some instances, differences with the above-described embodiments may be pointed out. Moreover, it should be appreciated that these additional embodiments may include elements or components utilized in the above-described embodiments although not shown or described. Thus, the descriptions of these additional embodiments are merely exemplary and not all-inclusive nor exclusive. Moreover, it should be appreciated that the features, components, elements and functionalities of the various embodiments may be combined or altered to achieve a desired fire extinguisher without departing from the spirit and scope of the present teachings.

Additional embodiments of a fire extinguisher 100 are shown in FIGS. 9-13. The fire extinguisher 100 may include a housing 112. The housing 112 may be any suitable size and shape. The housing 112 may include visually pleasing aesthetic features that may include, without limitation, various sizes, shapes, decorative elements and colors so that the fire extinguisher 100 may be used as a decorative element. The housing 112 may be made from any suitable materials including, but not limited to, metal, plastic and composites.

The fire extinguisher 100 may include a fire suppression agent 116, such as that described above or any other appropriate combination of expellant and suppressant agents now known or later invented may be utilized. The fire suppression agent 116 may further include any suitable combination of solid and liquid aerosols, such as by way of non-limiting examples, pressurized aerosol foam or spray or pyrotechnic-based chemicals.

The fire extinguisher 100 may include a discharge port 118 that may provide an exit path for the fire suppression agent 116 when fire extinguisher is in use, i.e., when an actuator 120 (described below) has been activated by a user. The discharge port 118 may be sized and shaped to provide any desired discharge rate for the fire suppression agent 116. In addition, the discharge port 18 may include directive or shaping elements to direct the discharge in any desired direction or spray pattern. The directive or shaping elements may be fixed, or may be adjustable by the user.

The actuator 120 may be a manual device sized and shaped for actuation by a user to cause the fire suppression agent 116 to flow from discharge port 118. The actuator 120 may be configured to detect the presence of a fire by any suitable means, such as thermal and infrared fire detection, and may automatically cause the fire suppression agent 116 to flow from discharge port 118. The actuator 120 may be a two-phase actuator 120. The actuator 120 may be initially activated (depressed) and then activated a second time before the fire suppressant agent 116 is expelled.

In generally manual embodiments, the actuator 120 may be biased in an "off" position, requiring a user to continuously actuate the actuator 120 in order to maintain the discharge of the fire suppression agent 116 from the discharge port 118. Alternatively, the actuator 120 may be configured to latch into an "on" position once manually activated, obviating the need for a user to continuously actuate the trigger mechanism. The user may then aim discharge port 118 at a fire, or the user may toss or throw fire extinguisher 110 into a fire to aid in suppression of the fire.

The actuator 120 may be a latching-type manual actuator 120, which may include a timing element whereby a predetermined amount of time passes after the actuator 120 activates before discharge of the fire suppression agent 116 from discharge port 118. The timing element may allow a user to activate the actuator 120 and move away from, toss or throw fire extinguisher 110 without significant exposure to the fire suppression agent 116.

The fire extinguisher 100 may further include an electrical connector 122. The electrical connector 122 may be configured of a suitable size, shape and with one or more connecting elements 124 to couple fire extinguisher 100 to any suitable power source, such as standard AC mains power. The electrical connector 122 may include any suitable connecting elements 124 to couple to an electrical power source, which may be AC or DC current. In some configurations electrical connector is fixed, while in other configurations the electrical connector is rotatable to facilitate placement on an electrical outlet and orientation to a desired position.

The electrical connector 122 may be used solely as a mechanical connector to detachably mount the fire extinguisher 100 to a mating electrical connector, such as a standard electrical outlet. Alternatively, the electrical connector 122 may be coupled to electrical power from an external source, such as the aforementioned electrical outlet, the electrical power at the electrical connector 122 in turn being electrically coupled to a power supply 126 disposed within housing 112. The power supply 126 may be any suitable type of power supply, converting the electrical power to one or more AC or DC voltage levels and current ratings. The power supply 126 may also include one or more batteries, and may further include a charging circuit to charge the battery using electrical power from the aforementioned external source.

The fire extinguisher may include one or more visually perceivable displays 128, such as an indicator or a light, to facilitate identification of the fire extinguisher 100 in the event that other illumination is not available. This may help enable a user to locate the fire extinguisher 100 when needed. The electrical power may also be utilized to automatically activate actuator 120 as detailed above, without the need for manual intervention of a user, when the fire extinguisher 100 is in the presence of a detected fire. The displays 128 may also be configured for operation as night nights, and may optionally include light sensors to turn off the displays when a predetermined level of ambient light is detected.

The fire extinguisher 100 may also include one or more status indicators 130. The status indicators 130 may indicate to a user the condition of fire extinguisher 100, such as charging status of a battery of power supply 126, a need for replacement of batteries, and whether or not the pressure or other condition of fire suppression agent 116 is acceptable. The status indicators 130 may include red and green lights. The green light may emit light when the fire extinguisher 100 is in an operative condition and the red light may emit light when the fire extinguisher 100 is in an inoperative condition.

The status indicator 130 may be powered by the aforementioned external power source or power supply 126 to monitor the amount of fire expellant and suppressant remaining in fire extinguisher 100 and may provide a visual alert, aural alert, or both if the remaining amount falls below a predetermined level.

Similarly, the status indicator 130 may be powered by the external power source or power supply 126 and may provide a visual alter, aural alert, or both if the fire extinguisher 100 should be replaced. Criteria for triggering such a replacement indication include, without limitation, vessel 114 pressure level, amount of fire expellant and suppressant remaining in the vessel 114, and an expiration date of fire extinguisher 100 as determined by an internal clock or other timekeeping device (not shown).

Figure 14:
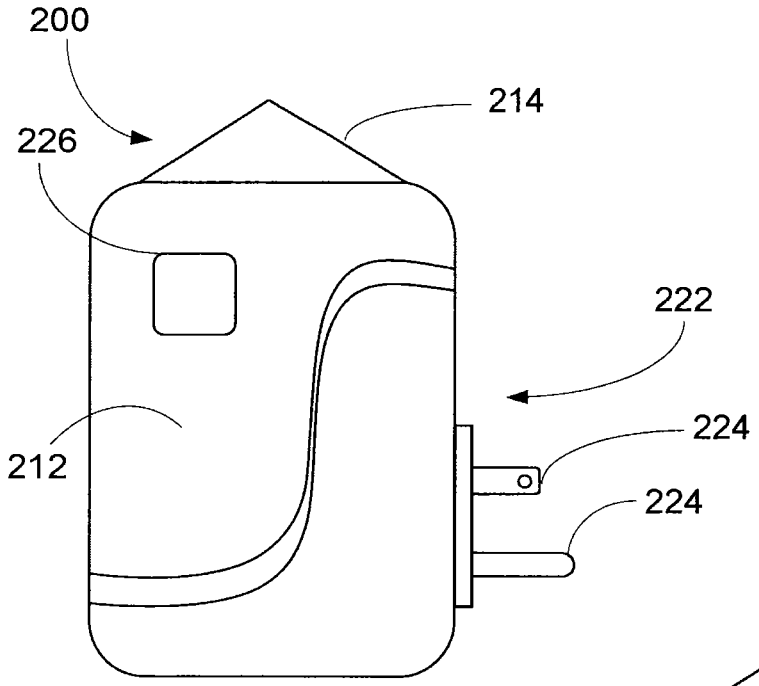
FIG. 14 is a first elevational view of other embodiments of a fire extinguisher.
Figure 15:
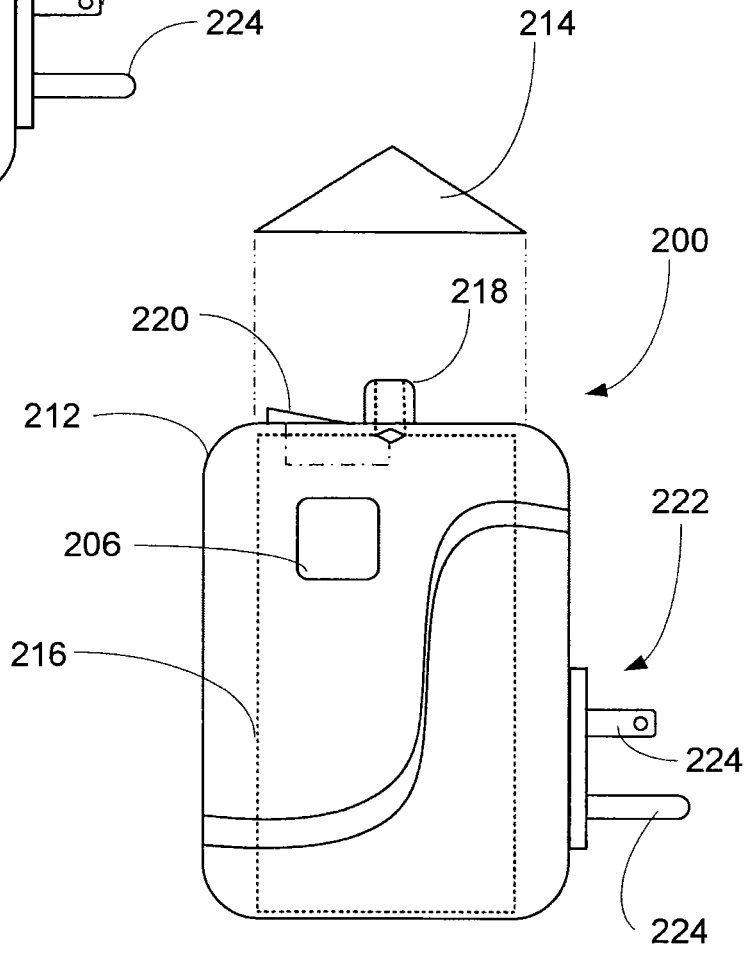
FIG. 15 is an elevational view with a partially exploded view of the fire extinguisher of FIG. 14.

Further embodiments of a fire extinguisher 200 are shown in FIGS. 14-15. The fire extinguisher 200 may include a housing 212 and a selectively detachable cap 214. The fire extinguisher 200 may further include an appropriate quantity of a fire suppression agent 216. The fire extinguisher 200 may include a discharge port 218 that may be selectively coupled to the fire suppression agent 216 by an actuator 220. The fire extinguisher 200 may include an electrical connector 222.

The housing 212 of the fire extinguisher 200 may be of any suitable size and shape. The housing 212 may include visually pleasing aesthetic features which may include, without limitation, various shapes, decorative elements and colors. The housing 212 may be made from any suitable materials including, but not limited to, metal, plastic and composites.

The cap 214 may be any suitable size and shape for the housing 212 of the fire extinguisher 200. The cap 214 may be selectively detachable from housing 212, as shown in FIG. 15. In other embodiments, the cap 214 may be hingedly connected with the housing 212, such as through any suitable device, including, without limitation to, a "living hinge." In still other embodiments, the cap 214 may be retained to housing 212, being selectively movable from a closure position adjacent the housing 212 to an open position spaced-apart from the housing 212. The cap 214 may include visually pleasing esthetic features such as, without limitation, various shapes, decorative elements and colors. The cap 214 may be made from any suitable materials including, but not limited to, metal, plastic and composites. The cap 214 may generally match the housing 212, such as being of generally the same material and color, or may be generally different from the housing 212, such as being of a different color or material.

The discharge port 218 may be positioned within the housing and may provide an exit path for the fire suppression agent 216 when fire extinguisher 200 is in use. The discharge port 218 may be sized and shaped to achieve any desired discharge rate for fire suppression agent 216. In addition, the discharge port 218 may include directive or shaping elements to direct the discharge in any desired spray or discharge pattern. Still further, the discharge port 218 may be of a shape and size such that it may blend with the housing 212, which may result in an aesthetically pleasing finish.

The actuator 220 may be located in any appropriate position in the housing 212. The actuator 220 may be a manual device sized and shaped for actuation by a user to cause fire suppression agent 216 to flow from discharge port 218. In some embodiments the actuator 220 may be configured to detect the presence of a fire by any suitable means, such as thermal and infrared fire detection, and may automatically cause the fire suppression agent 216 to flow from discharge port 218. In still other embodiments the actuator 220 may both manual and automatic.

If manual, the actuator 220 may be biased in an "off" position, requiring a user to continuously actuate the actuator 220 in order to maintain discharge of the fire suppression agent 216 from the discharge port 218. In other embodiments, the actuator 220 may be configured to latch into an "on" position once manually actuated, obviating the need for a user to continuously actuate the actuator 220. The user may then aim discharge port 218 at a fire, or the user may toss or throw fire extinguisher 200 into a fire to aid in suppression of the fire.

Further, a latching-type manual actuator 220 may include a timing element whereby a predetermined amount of time passes after the actuator 220 is actuated before discharge of fire suppression agent 216 from discharge port 218 begins. The timing element may allow a user to actuate the actuator 220 and then to move away from, toss, or throw the fire extinguisher 200 without significant exposure to the fire suppression agent 216.

The electrical connector 222 may be configured of a suitable size and shape, and may include connecting elements 224 that may be capable of coupling to any suitable power source, such as standard AC mains power. The electrical connector 224 may have any standard or proprietary connecting elements 224 to couple to an electrical power source, which may be AC or DC.

Electrical power provided to the electrical connector 224 may optionally be used to power one or more visually perceivable displays 226 (such as an indicator or light) on the fire extinguisher 200. This may facilitate identification of the fire extinguisher 200, if other illumination is not available at a particular location to enable a user to locate the fire extinguisher 200. The electrical power may also be utilized to automatically actuate actuator 220 as detailed above without the need for manual intervention in the presence of fire.

In operation, in the event of a fire a user simply locates a nearby fire extinguisher 200; the user may detach the cap 214, and may activate the actuator 220—such as through a two-phase operation described above. If the actuator 220 is a manual biased mechanism, the user may continuously actuate the actuator 220 while aiming discharge port 218 at the fire. If actuator 220 is a manual latching mechanism (with or without a time delay element), the user may actuate the actuator 220 and then may aim the discharge port 218 at the fire or toss or throw the fire extinguisher 200 into the fire. If the actuator 220 is automatic, in the event of a detected fire the actuator 220 may automatically cause fire suppression agent 216 to flow from discharge port 218, the flowing fire suppression agent 216 may urge cap 214 away from container 212.

The fire extinguisher 200 may include a smoke/fire detection and alerting device. In this embodiment, this device will detect the presence of smoke or fire, and activate an aural alter, visual alert or both to occupants.

Figure 16:
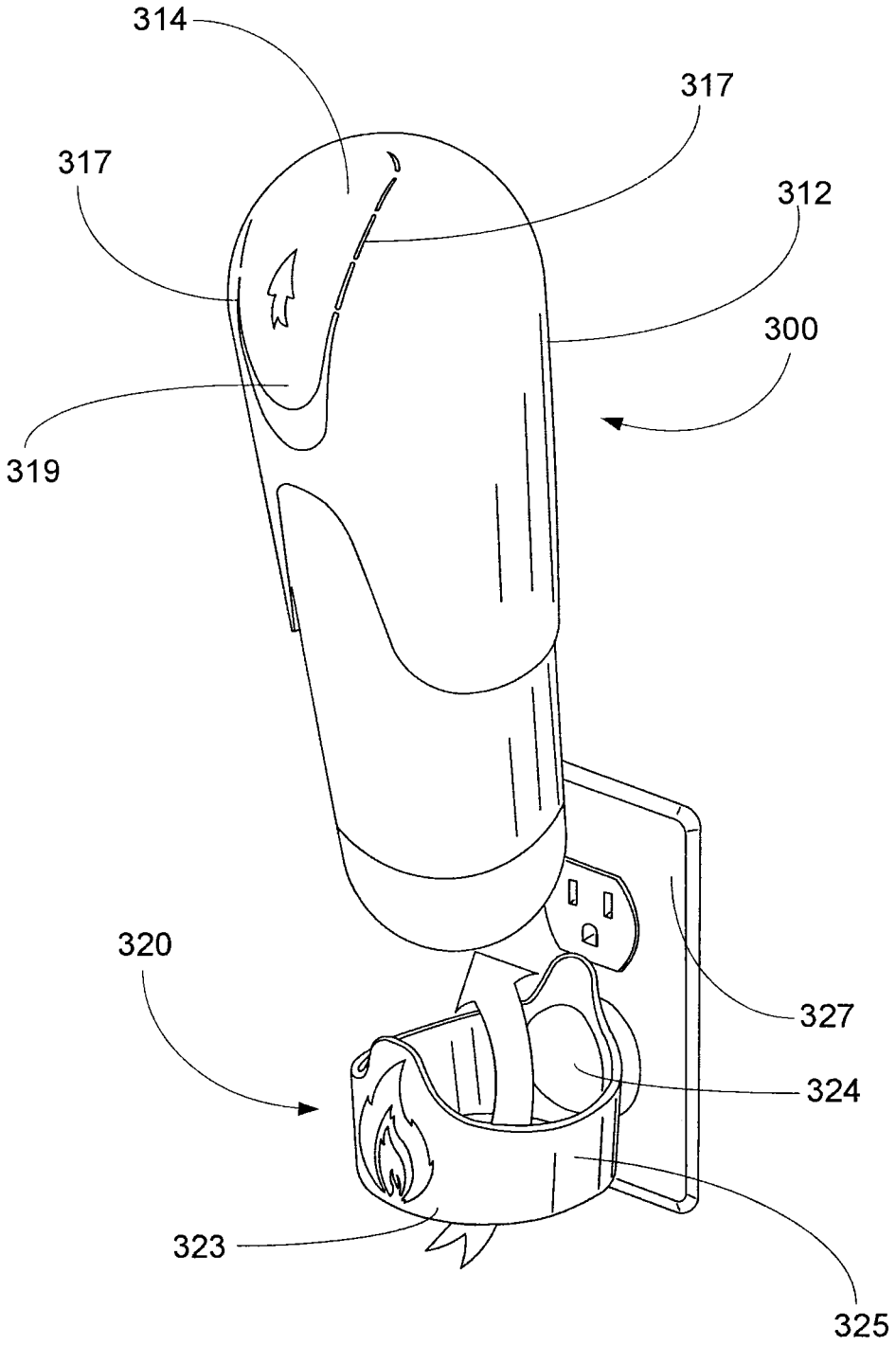
FIG. 16 is a perspective view of other embodiments of a fire extinguisher.

Still further embodiments of a fire extinguisher 300 are shown in FIG. 16. The fire extinguisher 300 may include any appropriate components discussed above. By way of a non-limiting example, the fire extinguisher 300 may include a housing 312 and a detachable tab 314. The fire extinguisher 300 may further include an appropriate quantity of a fire suppression agent (not shown). The fire extinguisher 300 may include a discharge port (not shown) selectively coupled to the fire suppression agent by an actuator (not shown). The detachable tab 314 may generally cover the actuator and discharge port, which may further add to the decorative finish of the fire extinguisher 300.

The housing 312 may be of any suitable size and shape. The housing 312 may include visually pleasing aesthetic features which may include, without limitation, various shapes, decorative elements and colors. The housing 312 may be made from any suitable materials including, but not limited to, metal, plastic and composites.

The detachable tab 314 may be any suitable size and shape for the housing 312 of the fire extinguisher 300. The detachable tab 314 may be selectively detachable from housing 312. By way of a non-limiting example, the detachable tab 314 may include perforated side portions 317 and a gripping portion 319. In such configuration, a user may pull on the gripping portion 319 and the perforated side portions 317 may detach from the housing 312 such that either the detachable tab 314 is removed or otherwise repositioned. The detachable tab 314 may include visually pleasing esthetic features such as, without limitation, various shapes, decorative elements and colors. The detachable tab 314 may be made from any suitable materials, including, but not limited to, metal, plastic and composites. The detachable tab 314 may generally match the housing 312, such as being of generally the same material and color, or may be generally different from the housing 312, such as being of a different color or material.

The fire extinguisher 300 may further include an electrical connector 322. The electrical connector 322 may be configured of a suitable size and shape. The electrical connector 322 may include a housing engaging member 323 capable of selectively engaging and retaining the housing 312. The housing engaging member 323 may be of any appropriate shape and size. By way of a non-limiting example, the housing engaging member 323 may have an annular body 325 into which the housing 312 may be inserted and may be generally retained in a storage position therein. The housing engaging member 323 may include connecting elements 324 capable of coupling to any suitable power source 327, such as standard AC main power.

In operating the fire extinguisher 300, the electrical connector 322 may be operably secured with the power source 327 to provide suitable power to the fire extinguisher 300 during a storage state. Specifically, the connecting elements 324 of the housing engaging member 323 may be inserted and electrically connected with the power source 327. The annular body 325 may extend from the power source 327. The housing 312 may then be selectively inserted into the housing engaging member 323, such as by being inserted into the annular body 325. The housing 312 may be electrically engaged with the housing engaging member 323 such that electrical power flows from the power source 327 through the electrical connector 324 and into appropriate electrical system in the housing 312. By way of a non-limiting example, the housing 312 may include a housing electrical connection member (not shown) that is selectively and electrically engageable with the housing engaging member 323. The fire extinguisher 300 may then be powered by the power source 327.

The connecting elements 324 may be selectively positionable. By way of a non-limiting example, the connecting elements 324 may be rotatable relative to the annular body 325. This may allow the housing 312 to be stored in either of a generally vertical or horizontal position. In these embodiments, the housing 312 may be inserted into the annular body 325 and the connecting elements 324 may be rotated relative to the annular body 325 such that the housing 312 may be positioned in any appropriate location. In the alternative, the annular body 325 may be positionable, for example, rotatable relative to the connecting elements 324.

When using the fire extinguisher 300, the housing 312 may be removed from the housing engaging member 323 such as by lifting it through the annular body 325. The user may then grasp the gripping portion 319 and pull it in an appropriate direction. As the detachable tab 314 includes perforations 317, pulling the detachable tab 314 may remove it from or reposition it on the housing 312. This may then expose the actuator and discharge port to the user. The user may then activate the actuator, such as described above, and the fire suppression agent may be expelled through the discharge port.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. A fire extinguisher comprising:
- a housing;
- a vessel positioned within the housing, the vessel retaining a fire suppression agent therein;
- an actuator;
- a discharge port operatively coupled to the vessel by the actuator;
- a puncturable high pressure gas cartridge positioned within the housing, the actuator operable to puncture the puncturable high pressure gas cartridge and to cause the fire suppression agent to combine with gas from the puncturable high pressure gas cartridge to propel the fire suppression agent through the discharge port; and
- an electrical connector positioned on the housing, the electrical connector capable of operatively securing to and being electrically connected to a standard electrical outlet, the electrical connector containing at least two-prongs extending therefrom,
- wherein the fire extinguisher includes a child safety feature in which an initial depression of the actuator does not expel the fire suppression agent, but a second depression of the actuator expels the fire suppression agent.

2. The fire extinguisher of claim 1, wherein the electrical connector is rotatable to retain the housing in at least one of a generally vertical and horizontal position when the electrical connector operatively connects with the electrical outlet.

3. The fire extinguisher of claim 1, wherein the housing includes a decorative finish.

4. The fire extinguisher of claim 3, further comprising an indicator positioned in the housing, the indicator identifying expiration of the fire suppression agent.

5. The fire extinguisher of claim 1 further comprising a light source positioned in the housing.

6. The fire extinguisher of claim 5, wherein the light source emits light exteriorly of the housing.

7. The fire extinguisher of claim 6, further comprising a sensor positioned within the housing and operatively secured with the light source.

8. The fire extinguisher of claim 7, wherein the sensor is capable of detecting an absence of light.

9. The fire extinguisher of claim 8, wherein the sensor detecting the absence of light causes the light source to illuminate.

10. The fire extinguisher of claim 1, further comprising a smoke sensor disposed within the housing, the smoke sensor detects the presence of smoke.

11. The fire extinguisher of claim 10, further comprising an audible alert, wherein the smoke sensor detecting smoke causes the audible alert to activate.

12. The fire extinguisher of claim 11, wherein the smoke sensor detecting smoke causes the light source to illuminate.

13. The fire extinguisher of claim 1, further comprising a cap selectively engageable with the housing, wherein the cap generally covers the actuator.

14. The fire extinguisher of claim 13, wherein the cap includes a decorative finish.

15. The fire extinguisher of claim 1, further comprising a power supply positioned within the housing.

16. The fire extinguisher of claim 15, wherein the power supply includes at least one battery.

17. The fire extinguisher of claim 1, wherein an initial depression of the actuator punctures the puncturable high pressure gas cartridge but does not expel the fire suppression agent, a second depression of the actuator expels the fire suppression agent.

18. A fire extinguisher comprising:
- a housing;
- a vessel positioned within the housing, the vessel retaining a fire suppression agent therein;
- a discharge port operatively coupled to the vessel; and
- an electrical connector operably coupled to the housing, the electrical connector capable of operatively securing to a standard electrical outlet, the electrical connector containing at least two-prongs extending therefrom, wherein the electrical connector solely mechanically, but not electrically, connects to the standard electrical outlet such that electrical power does not flow from the standard electrical outlet through the electrical connector.

19. The fire extinguisher of claim 18, further comprising an actuator operably coupled to the vessel, wherein the actuator is operable to discharge the fire suppression agent from the vessel through the discharge port.

20. The fire extinguisher of claim 19, wherein the fire extinguisher includes a feature in which an initial depression of the actuator does not expel the fire suppression agent, but a second depression of the actuator expels the fire suppression agent.

* * * * *